US007882648B2

(12) United States Patent
Langvin

(10) Patent No.: US 7,882,648 B2
(45) Date of Patent: Feb. 8, 2011

(54) FOOTWEAR WITH LAMINATED SOLE ASSEMBLY

(75) Inventor: Elizabeth Langvin, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 901 days.

(21) Appl. No.: 11/766,127

(22) Filed: Jun. 21, 2007

(65) Prior Publication Data

US 2008/0313932 A1 Dec. 25, 2008

(51) Int. Cl.
*A43B 23/28* (2006.01)

(52) U.S. Cl. ..... 36/59 R; 36/59 C; 36/30 R; 36/67 R

(58) Field of Classification Search ..... 36/59 R, 36/25 R, 59 C, 134, 67 R, 30 R, 4, 32 R
See application file for complete search history.

(56) References Cited

U.S. PATENT DOCUMENTS 583,641 A 6/1897 Brown
2,071,431 A 2/1937 Riddell
2,147,197 A 2/1939 Glidden
2,773,317 A 12/1956 Hello
2,930,149 A 3/1960 Hack, et al.
2,932,829 A 5/1960 Corbin
3,013,564 A 12/1961 Levy
3,129,520 A 4/1964 Funck
3,490,155 A 1/1970 Herunter
3,947,979 A 4/1976 Sidles
4,094,081 A 6/1978 Reiner et al.
4,096,649 A 6/1978 Saurwein
4,130,947 A * 12/1978 Denu ..... 36/30 R
4,151,661 A * 5/1979 Namba et al. ..... 36/30 R
4,241,524 A * 12/1980 Sink ..... 36/102
4,259,792 A 4/1981 Halberstadt
4,276,671 A 7/1981 Melton
4,309,831 A 1/1982 Pritt
4,372,058 A 2/1983 Stubblefield
4,389,798 A 6/1983 Tilles
4,402,145 A 9/1983 Dassler
4,461,288 A 7/1984 Curtis
4,569,142 A 2/1986 Askinasi
4,607,440 A 8/1986 Roberts et al.
D288,742 S 3/1987 Caretti
4,741,114 A 5/1988 Stubblefield
4,827,631 A 5/1989 Thornton
5,077,916 A 1/1992 Beneteau
5,079,856 A 1/1992 Truelsen
5,367,791 A * 11/1994 Gross et al. ..... 36/31
5,526,584 A 6/1996 Bleimhofer et al.

(Continued)

FOREIGN PATENT DOCUMENTS

DE 1674858 3/1954

(Continued)

*Primary Examiner*—Marie Patterson
(74) *Attorney, Agent, or Firm*—Banner & Witcoff, Ltd.

(57) ABSTRACT

An article of footwear includes an upper and a sole assembly positioned beneath the upper. The sole assembly includes an outer layer having a plurality of recesses formed in an upper surface thereof, with each recess forming a corresponding projection on a lower surface of the outer layer. Each of a plurality of core members is received in one of the recesses. An inner layer is laminated to the outer layer, thereby capturing the core members between the outer and inner layers.

20 Claims, 3 Drawing Sheets

U.S. PATENT DOCUMENTS

| | | | | |
|---|---|---|---|---|
| D385,102 | S | 10/1997 | Avar | |
| 5,676,641 | A | 10/1997 | Arensdorf et al. | |
| 5,689,903 | A | 11/1997 | Aumann | |
| 5,692,319 | A | 12/1997 | Parker et al. | |
| 5,761,832 | A * | 6/1998 | George | 36/59 C |
| 5,815,949 | A | 10/1998 | Sessa | |
| 5,819,439 | A | 10/1998 | Sanchez | |
| 5,836,094 | A * | 11/1998 | Figel | 36/131 |
| 5,918,385 | A | 7/1999 | Sessa | |
| 5,926,974 | A * | 7/1999 | Friton | 36/28 |
| 6,018,889 | A * | 2/2000 | Friton | 36/28 |
| 6,226,896 | B1 * | 5/2001 | Friton | 36/28 |
| D444,940 | S | 7/2001 | Murrey | |
| 6,266,897 | B1 * | 7/2001 | Seydel et al. | 36/29 |
| 6,385,866 | B1 | 5/2002 | Sotter | |
| 6,516,540 | B2 * | 2/2003 | Seydel et al. | 36/29 |
| 6,615,512 | B2 | 9/2003 | Sink | |
| 7,047,672 | B2 | 5/2006 | Hoffer et al. | |
| 7,082,703 | B2 | 8/2006 | Greene et al. | |
| 7,200,955 | B2 * | 4/2007 | Foxen | 36/25 R |
| 7,204,044 | B2 | 4/2007 | Hoffer et al. | |
| 2002/0078599 | A1 | 6/2002 | Delgorgue et al. | |
| 2002/0092201 | A1 * | 7/2002 | Kraeuter et al. | 36/25 R |
| 2003/0121179 | A1 * | 7/2003 | Chen | 36/30 R |
| 2008/0216360 | A1 * | 9/2008 | Schenone | 36/30 R |

FOREIGN PATENT DOCUMENTS

| | | |
|---|---|---|
| DE | 3910294 | 10/1990 |
| EP | 0152033 | 8/1985 |
| EP | 0447231 | 9/1991 |
| EP | 1033086 | 9/2000 |
| FR | 1434840 | 2/1966 |
| GB | 2072486 | 10/1981 |
| GB | 2249939 | 5/1992 |
| GB | 2162043 | 9/2007 |

* cited by examiner

FOOTWEAR WITH LAMINATED SOLE ASSEMBLY

FIELD OF THE INVENTION

This invention relates generally to an article of footwear, and, in particular, to an article of footwear with a laminated sole assembly.

BACKGROUND OF THE INVENTION

Current shoe designs, and, more specifically, current shoe sole designs, do not work particularly well when used by individuals to walk, run, jump or otherwise move on granular surfaces, e.g., sand and snow. Current shoe designs are limiting in that much of the energy exerted by the wearer is lost, since the wearer's shoe tends to slip when they move. This energy loss is prevalent during propulsion as well as during braking or stopping.

This is especially problematic when the wearer is running, playing volleyball, or engaged in any type of athletic activity in which traction and the ability to stop quickly are paramount. Suitable footwear for such activities requires good traction and is preferably lightweight. The competitive nature of some athletic activities being performed on granular surfaces, e.g., professional beach volleyball, and the increase in the number of such athletic activities in which people are engaged, has brought greater attention to this issue and increased the need for a solution.

It is an object of the present invention to provide a sole for an article of footwear that reduces or overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

The principles of the invention may be used to advantage to provide an article of footwear with a laminated sole assembly. In accordance with a first aspect, an article of footwear includes an upper and a sole assembly positioned beneath the upper. The sole assembly includes an outer layer having a plurality of recesses formed in an upper surface thereof, with each recess forming a corresponding projection on a lower surface of the outer layer. Each of a plurality of core members is received in one of the recesses. An inner layer is laminated to the outer layer, thereby capturing the core members between the outer and inner layers.

In accordance with another aspect, an article of footwear includes an upper and a sole assembly positioned beneath the upper. The sole assembly includes an outer layer formed of a stretchable material having a plurality of recesses formed in an upper surface thereof, with each recess forming a corresponding projection on a lower surface of the outer layer. Each of a plurality of cleats is received in one of the recesses. An inner layer formed of an elastomeric material is laminated to the outer layer, thereby capturing the cleats between the outer and inner layers.

In accordance with a further aspect, an article of footwear includes an upper and a sole assembly positioned beneath the upper. The sole assembly includes an outer layer formed of a rubber material having a spandex backing, and has a plurality of recesses formed in an upper surface thereof. Each recess forms a corresponding projection on a lower surface of the outer layer. Each of a plurality of cleats is received in one of the recesses. An inner layer formed of neoprene is laminated to the outer layer, thereby capturing the cleats between the outer and inner layers.

Substantial advantage is achieved by providing footwear with a laminated sole assembly. In particular, certain embodiments provide footwear that is lightweight and provides good traction so a user can walk, run, jump or otherwise move on granular surfaces, e.g., sand and snow. Such footwear is particularly advantageous for a user competing athletic activities being performed on granular surfaces, e.g., beach volleyball.

These and additional features and advantages disclosed here will be further understood from the following detailed disclosure of certain embodiments.

Figure 1:
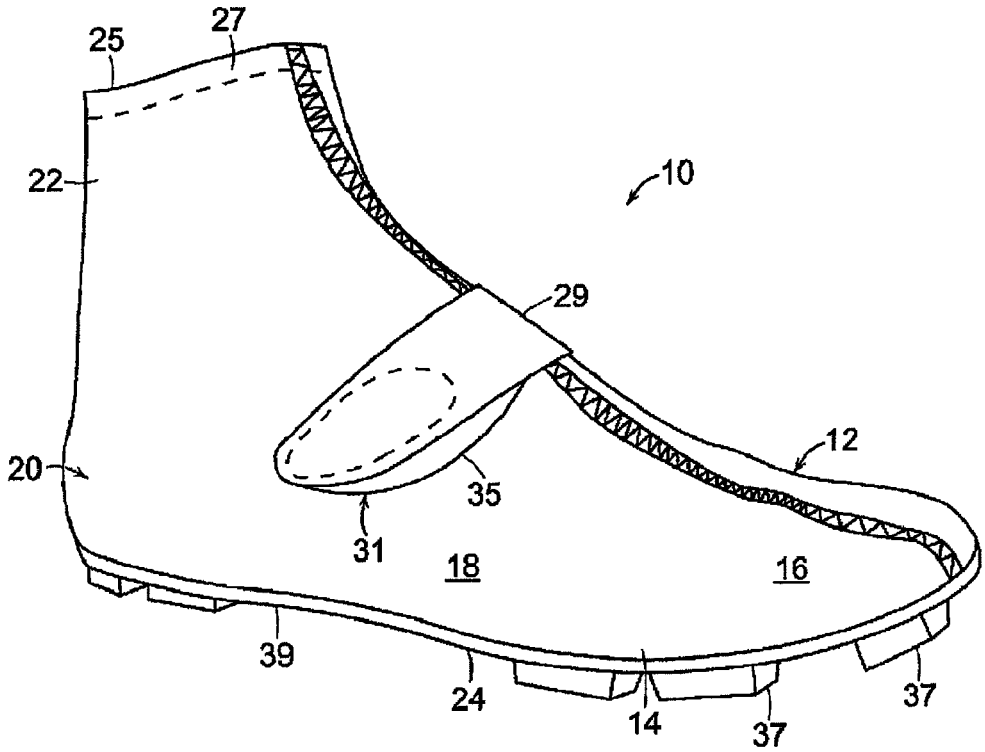
FIG. 1 is an elevation view of an article of footwear with a laminated sole in accordance with a preferred embodiment of the present invention.

The figures referred to above are not drawn necessarily to scale and should be understood to provide a representation of particular embodiments of the invention, and are merely conceptual in nature and illustrative of the principles involved. Some features of the footwear with a laminated sole assembly depicted in the drawings have been enlarged or distorted relative to others to facilitate explanation and understanding. The same reference numbers are used in the drawings for similar or identical components and features shown in various alternative embodiments. Footwear with a laminated sole assembly as disclosed herein would have configurations and components determined, in part, by the intended application and environment in which they are used.

DETAILED DESCRIPTION OF CERTAIN PREFERRED EMBODIMENTS

Figure 2:
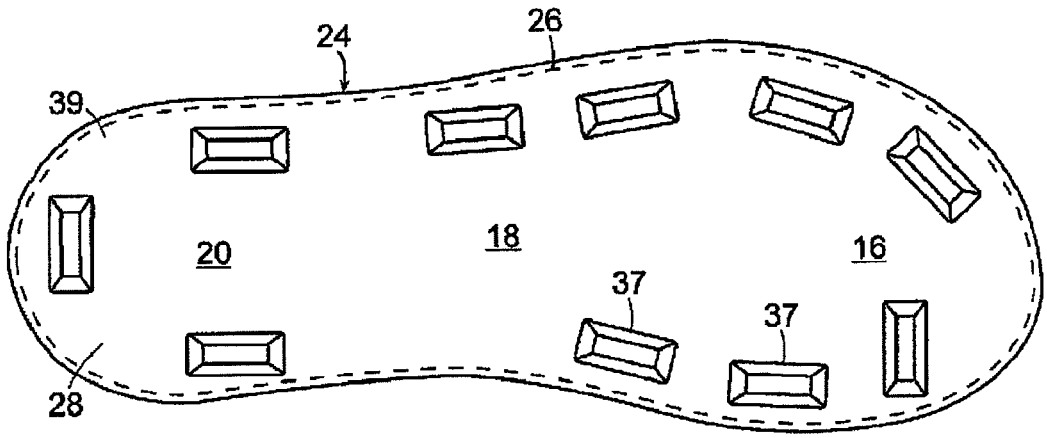
FIG. 2 is a plan view of the bottom surface of the article of footwear of FIG. 1.
Figure 3:
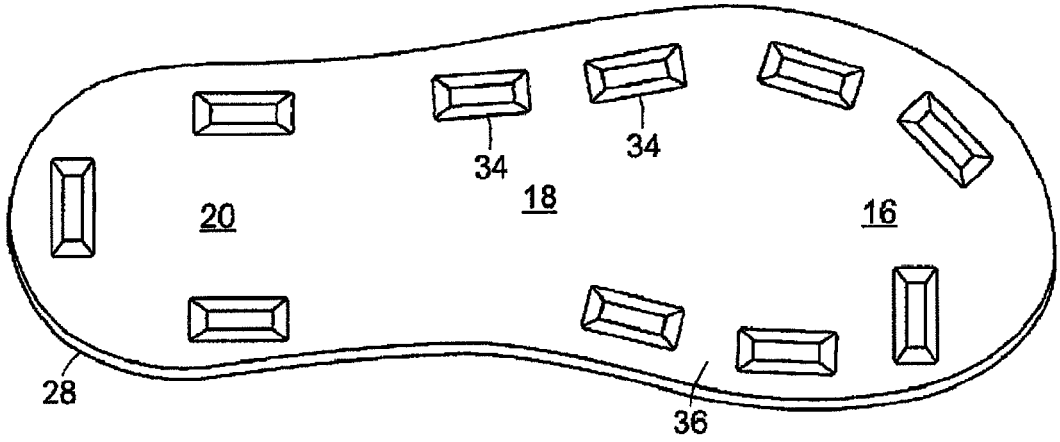
FIG. 3 is a perspective view of an upper surface of an outer layer of a sole assembly of the article of footwear of FIG. 1.
Figure 4:
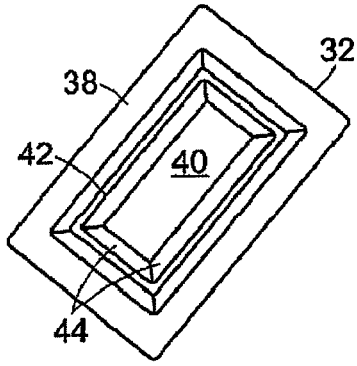
FIG. 4 is a perspective view of one embodiment of a core member of the sole assembly of the article of footwear of FIG. 1.
Figure 5:
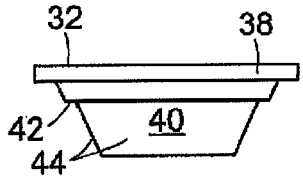
FIG. 5 is an elevation view of the core member of FIG. 4.
Figure 6:
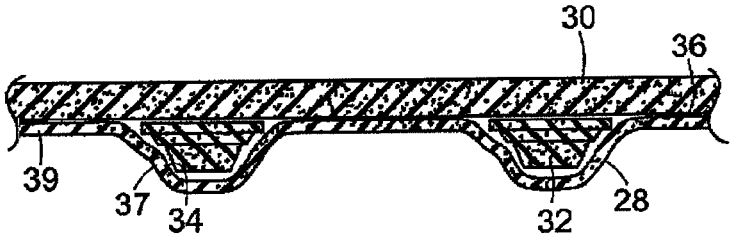
FIG. 6 is a section view of the sole assembly of the article of footwear of FIG. 1.

The present invention may be embodied in various forms. A preferred embodiment of an article of footwear 10 is shown in FIGS. 1-3. Footwear 10 has a medial, or inner, side 12 and a lateral, or outer, side 14. For purposes of general reference, footwear 10 may be divided into three general portions: a forefoot portion 16, a midfoot portion 18, and a heel portion 20. Portions 16, 18, and 20 are not intended to demarcate precise areas of footwear 10. Rather, portions 16, 18, and 20 are intended to represent general areas of footwear 10 that provide a frame of reference during the following discussion.

Forefoot portion 16 generally includes portions of footwear 10 corresponding with the toes and the joints connecting the metatarsals with the phalanges. Midfoot portion 18 generally includes portions of footwear 10 corresponding with the arch area of the foot, and heel portion 20 corresponds with rear portions of the foot, including the calcaneus bone. Medial side 12 and lateral side 20 extend through each of portions 16-20 and correspond with opposite sides of footwear 10. Portions 16-20 and sides 12-14 are not intended to demarcate precise areas of footwear 10. Rather, portions 16-20 and sides 12-14 are intended to represent general areas of footwear 10 to aid in the following discussion. Portions 16-20 and sides 12-14 may also be applied to upper 22 specifically, or any other portion of footwear 10.

In the embodiment illustrated in FIG. 1, footwear 10 does not include separate midsole or insole elements. However, it is to be appreciated that in other embodiments, footwear 10 may include a midsole element, an insole element, or both.

Unless otherwise stated, or otherwise clear from the context below, directional terms used herein, such as rearwardly, forwardly, inwardly, downwardly, upwardly, etc., refer to directions relative to footwear 10 itself. Footwear 10 is shown in FIG. 1 to be disposed substantially horizontally, as it would be positioned on a horizontal surface when worn by a wearer. However, it is to be appreciated that footwear 10 need not be limited to such an orientation. Thus, in the illustrated embodiment of FIG. 1, rearwardly is toward heel portion 20, that is, to the left as seen in FIG. 1. Naturally, forwardly is toward forefoot portion 16, that is, to the right as seen in FIG. 1, and downwardly is toward the bottom of the page as seen in FIG. 1.

Footwear 10 includes an upper 22 and a sole assembly 24 secured at least about its peripheral edge to upper 22. As seen in FIG. 2, sole assembly 24 may be secured to upper 22 by way of stitching 26. In other preferred embodiments, sole assembly 24 may be secured to upper 22 by an adhesive, or any other suitable fastener.

Upper 22 may take the form of a bootie, as seen in the embodiment illustrated in FIG. 1, rising above the ankle of the wearer, terminating in a collar 25, which is preferably positioned above the medial malleolus, or inner ankle bone, of the user, thereby providing a gapless gasket seal above the user's ankle. In preferred embodiments, upper 22 is formed of a flexible textile material, which can easily stretch about and conform tightly to the user's foot. In preferred embodiments, this textile can be made of such a gauge or density that sand particles do not readily enter the spaces in between the yarns. Upper 22 may be formed of, for example, knit, woven or non-woven material made using fibers such as, but not limited to, nylon, polyester, polyurethane and or spandex, with elastomeric properties. Textiles with ultraviolet light protection qualities may be used, and textiles with the capability of allowing the wearer to tan through them may also be used. Other suitable materials for upper 22 will become readily apparent to those skilled in the art, given the benefit of this disclosure.

In a preferred embodiment, a coating 27 is applied around an inside upper peripheral edge of collar 25. Coating 27 may be an elastomeric and tacky polymer, such as, but not limited to polyurethane (PU), silicone, nylon, polyester, or an acrylic based polymer. Coating 27 serves to allow the edge of collar 25 to be finished without a binding to reduce fraying, to help collar 25 adhere to the skin of the user in order to minimize the amount of sand entering footwear 10, and to capture any grains of sand that may work their way inside footwear 10. A protective coating may also be applied to seams and/or stitching on other portions of footwear 10 for the purpose of durability and to prevent the textile from fraying. For example, stitching 26 that secures sole assembly 24 to upper 22 may have such a coating. Additionally, coatings may also be applied to the textile upper, either internally or externally, to provide enhanced textile durability in high wear areas such as, but not limited to, the areas above and beneath the toes in forefoot portion 16, and the instep in midfoot portion 18.

A strap 29 extends across an instep of upper 22 from medial side 12 to lateral side 14 of midfoot portion 18. A fastener 31 releasably secures strap 29 to upper 22. In the illustrated embodiment, strap 29 includes a first portion 33 of fastener 31. A second portion 35 of fastener 31 is secured to upper 22. Each of first and second portions 33, 35 may be, as illustrated, one of a hook and loop portion of a hook and loop fastener. Other types of fasteners suitable for securing strap 29 will become readily apparent to those skilled in the art, given the benefit of this disclosure.

Sole assembly 24 is seen in FIGS. 3-6, and is formed of an outer layer 28, an inner layer 30, and a plurality of core members 32 positioned between outer layer 28 and inner layer 30. As seen in FIG. 3, a plurality of recesses 34 is formed in an upper surface 36 of outer layer 28, with each recess forming a corresponding projection 37 on a lower surface 39 of outer layer 28. Each recess 34 is configured and shaped to receive at least a portion of a corresponding core member 32 to form a traction element, such as a cleat.

Outer layer 28 may be formed of a flexible resilient material, such as a blown rubber material with a spandex backing, for example, other rubber materials, or any other suitable flexible resilient material. In certain embodiments, the spandex material backing may be one-way stretchable while in other embodiments it may be two-way stretchable. Other suitable materials for outer layer 28 will become readily apparent to those skilled in the art, given the benefit of this disclosure. Recesses 34 may be formed in outer layer 28 through compression molding, for example. Other methods of forming recesses 34 in outer layer 28 will become readily apparent to those skilled in the art, given the benefit this disclosure.

In certain embodiments, core members 32 take the form of cleats. It is to be appreciated that core members 32 can take many forms. For example, core members 32 could be pods, traction elements having any desired shape, or cushioning elements. Other suitable shapes of core members will be readily apparent to those skilled in the art, given the benefit of this disclosure.

Figure 8:
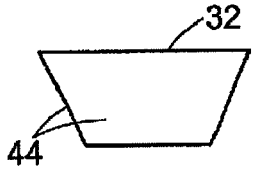
FIG. 8 is an elevation view of an alternative embodiment of the core member of FIG. 4.

As illustrated here, each core member 32 includes a base portion 38 and a projection 40 extending downwardly from base portion 38. A shoulder 42 is formed about projection 40 proximate base portion 38. Core member 32 includes four sidewalls 44 projecting downwardly and inwardly providing a tapered shape for core member 32. It is to be appreciated that core members 32 can have any desired shape. Thus, for example, core members 32 can be cylindrical, conical, rectangular, or any other desired shape. Another embodiment of core members 32 is seen in FIG. 8, in which core member 32 has no base portion or shoulder. Other suitable shapes for core members 32 will become readily apparent to those skilled in the art, given the benefit of this disclosure.

In certain embodiments, core members 32 may be formed of a resilient, polymer foam materials, such as ethylvinylacetate (EVA). In other embodiments, core members 32 may be formed of polyurethane, gel capsules, air bladders, or a rubber material, for example. Other suitable materials for core members 32 will become readily apparent to those skilled in the art, given the benefit of this disclosure.

As best seen in FIG. 2, in certain embodiments, core members 32 are positioned about the periphery of sole assembly 24. It is to be appreciated that core members 32 can be positioned anywhere throughout forefoot portion 16, midfoot portion 18 and/or heel portion 20.

After core members 32 have been seated in recesses 34, inner layer 30 is laminated to outer layer 28, thereby capturing core members 32 therebetween. Inner layer 30 and outer layer 28 may be laminated together with an adhesive. Once the elements of sole assembly 24 have been laminated together, sole assembly 24 can then be secured to upper 22 as noted above.

Inner layer 30 may be formed of flexible insulating materials such as neoprene foam, closed cell foams, polyether and polyester based PU foams, thermoplastic foams, polymer blends incorporating expanding polymeric or glass microspheres, a mesh or textile material. Other suitable materials for inner layer 30 will become readily apparent to those skilled in the art, given the benefit of this disclosure. In certain embodiments, the inner layer may be formed as part of upper 22 itself, or it may be the portion of footwear 10 that forms a footbed that contacts the user's foot directly.

Figure 7:
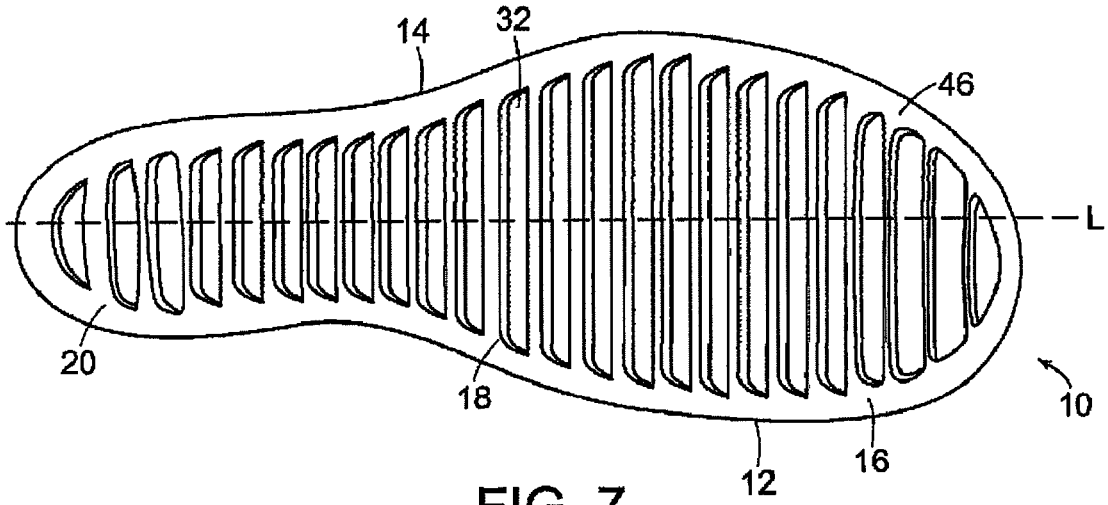
FIG. 7 is a plan view of an alternative embodiment of a core member of the sole assembly of the article of footwear of FIG. 1.

As noted above, core members 32 may take other shapes other than cleats. For example, as seen in FIG. 7 core members 32 take the form of ribs 32. As illustrated here, ribs 32 extend downwardly from a base portion 46. Ribs 32 are seated in recesses 34 shaped to correspond to the shapes of ribs 32. In the illustrated embodiment, ribs 32 extend substantially transversely to a longitudinal axis L of sole assembly 24. Transversely extending ribs 32 help provide traction for the user. It is to be appreciated, however, that ribs 32 can extend in any desired direction in other embodiments.

It is to be appreciated that sole assembly 24 can be positioned in other locations within footwear 10. In certain embodiments, sole assembly 24 need not necessarily be secured to an exterior surface of upper 22. For example, core members 32 could form part of a midsole or insole of footwear 10. Thus, core members 32 need not necessarily form the ground engaging portion of footwear 10. That is, core members 32 could be captured entirely within the midsole of footwear 10 to provide cushioning and support. Core members 32 could form part of a removable midsole, as illustrated in U.S. application Ser. No. 11/682,998, entitled "Footwear with Removable Midsole Having Projections," filed on Mar. 7, 2007, the entire disclosure of which is incorporated herein by reference in its entirety, in which core members 32 could extend through an upper plate that is in turn secured to an upper.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising, in combination:
an upper; and
a sole assembly positioned beneath the upper and comprising
an outer layer having a plurality of recesses formed in an upper surface thereof, each recess forming a corresponding projection on a lower surface of the outer layer, the outer layer being secured about a peripheral edge thereof to a peripheral edge of the upper;
a plurality of core members, each core member received in one of the recesses; and
an inner layer laminated to the outer layer thereby capturing the core members between the outer and inner layers.

2. The article of footwear of claim 1, wherein the outer layer is formed of a blown rubber material with a spandex backing.

3. The article of footwear of claim 1, wherein the inner layer is formed of an elastomeric material.

4. The article of footwear of claim 1, wherein the inner layer is formed of neoprene.

5. The article of footwear of claim 1, wherein each core member is formed of EVA.

6. The article of footwear of claim 1, wherein the core members comprise cleats.

7. The article of footwear of claim 6, wherein each cleat includes a base portion and a projection extending downwardly from a lower surface of the base portion.

8. The article of footwear of claim 6, wherein the projection includes four sidewalls projecting downwardly and inwardly from the base portion.

9. The article of footwear of claim 8, further comprising a shoulder formed on each sidewall proximate the base portion.

10. The article of footwear of claim 1, wherein the sole assembly is secured to the upper with stitching.

11. The article of footwear of claim 1, wherein the sole assembly forms an outsole of the article of footwear.

12. The article of footwear of claim 1, wherein the core members comprise ribs.

13. The article of footwear of claim 1, wherein the ribs extend substantially transversely to a longitudinal axis of the sole assembly.

14. An article of footwear comprising, in combination:
an upper; and
a sole assembly positioned beneath the upper and comprising
an outer layer formed of a stretchable material having a plurality of recesses formed in an upper surface thereof, each recess forming a corresponding projection on a lower surface of the outer layer, the outer layer being secured about a peripheral edge thereof to a peripheral edge of the upper;
a plurality of cleats, each cleat received in one of the recesses; and
an inner layer formed of an elastomeric material laminated to the outer layer thereby capturing the cleats between the outer and inner layers.

15. The article of footwear of claim 14, wherein the outer layer is formed of a blown rubber material with a spandex backing.

16. The article of footwear of claim 14, wherein the inner layer is formed of neoprene.

17. The article of footwear of claim 14, wherein each cleat is formed of EVA.

18. The article of footwear of claim 14, wherein each cleat includes a base portion and a projection extending downwardly from a lower surface of the base portion.

19. The article of footwear of claim 14, wherein the sole assembly is secured to the upper with stitching.

20. An article of footwear comprising, in combination:
an upper; and
a sole assembly positioned beneath the upper and comprising
an outer layer formed of a rubber material having a spandex backing and having a plurality of recesses formed in an upper surface thereof, each recess forming a corresponding projection on a lower surface of the outer layer, the outer layer being secured about a peripheral edge thereof to a peripheral edge of the upper;

a plurality of cleats, each cleat received in one of the recesses; and an inner layer formed of neoprene laminated to the outer layer thereby capturing the cleats between the outer and inner layers.

* * * * *